US006489008B1

(12) United States Patent
Campbell et al.

(10) Patent No.: US 6,489,008 B1
(45) **Date of Patent: *Dec. 3, 2002**

(54) INK JET RECORDING ELEMENT

(75) Inventors: Bruce C. Campbell, Rochester, NY (US); Thomas M. Laney, Brockport, NY (US); Lisa B. Todd, Rochester, NY (US); Lixin Chu, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 170 days.

This patent is subject to a terminal disclaimer.

(21) Appl. No.: 09/650,068

(22) Filed: Aug. 29, 2000

(51) Int. Cl.[7] ..... B41M 5/00
(52) U.S. Cl. ..... 428/195
(58) Field of Search ..... 347/105; 428/195, 428/480, 212

(56) References Cited

U.S. PATENT DOCUMENTS 5,354,601 A 10/1994 Kamijo et al. ..... 428/216
6,159,605 A * 12/2000 Hananda et al. ..... 428/423.1
6,228,475 B1 * 5/2001 Chu et al. ..... 428/304.4

* cited by examiner

*Primary Examiner*—Bruce H. Hess
(74) *Attorney, Agent, or Firm*—Harold E. Cole

(57) ABSTRACT

An ink jet recording element comprising an ink-permeable polyester substrate comprising a base polyester layer and an ink-permeable upper polyester layer, the upper polyester layer comprising a continuous polyester phase having an ink absorbency rate resulting in a dry time of less than about 10 seconds and a total absorbent capacity of at least about 14 $cc/m^2$, the substrate having thereon a porous image-receiving layer having interconnecting voids.

20 Claims, No Drawings

INK JET RECORDING ELEMENT

CROSS REFERENCE TO RELATED APPLICATIONS

Reference is made to commonly assigned, co-pending U.S. patent application Ser. No. 09/650,129 by Campbell et al., filed concurrently herewith entitled "Ink Jet Printing Method"; the disclosure of which is hereby incorporated by reference.

FIELD OF THE INVENTION

This invention relates to an ink jet recording element. More particularly, this invention relates to an ink jet recording element containing a porous ink receiving layer having interconnecting voids and an ink-permeable polyester substrate.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable: However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support.

While a wide variety of different types of image-recording elements have been proposed heretofore, there are many unsolved problems in the art and many deficiencies in the known products which have severely limited their commercial usefulness. The requirements for an image-recording medium or element for inkjet recording are very demanding. For example, the recording element must be capable of absorbing or receiving large amounts of ink applied to the image-forming surface of the element as rapidly as possible in order to produce recorded images having good quality, including high optical density and low coalescence, and that can be handled without smearing shortly after printing. Large amounts of ink are often required for printing high quality, photographic type images.

U.S. Pat. No. 5,354,601 discloses a recording sheet wherein an ink absorbing layer is coated on at least one side of a void-containing polyester film substrate. However, there is a problem with this element in that the voids in the polyester film are not connected to each other. Since there is no pathway for ink to penetrate, the substrate will not contribute to a faster dry time, as will be shown hereafter.

U.S. application Ser. No. 09/472,487 of Laney et al. filed Dec. 27, 1999, entitled, "Permeable Surface Imaging Support", discloses a permeable support for an imaging element which may have an ink receiving layer on top. However, there is no disclosure in this application that the ink receiving layer may be porous.

It is an object of this invention to provide an ink jet recording element that has a fast ink dry time. It is another object of this invention to provide an ink jet recording element that has good image density.

SUMMARY OF THE INVENTION

These and other objects are achieved in accordance with the invention which comprises an ink jet recording element comprising an ink-permeable polyester substrate comprising a base polyester layer and an ink-permeable upper polyester layer, the upper polyester layer comprising a continuous polyester phase having an ink absorbency rate resulting in a dry time of less than about 10 seconds and a total absorbent capacity of at least about 14 cc/m$^2$, the substrate having thereon a porous image-receiving layer having interconnecting voids.

The ink jet recording element of the invention provides a fast ink dry time and good image density.

DETAILED DESCRIPTION OF THE INVENTION

As noted above, the ink-permeable polyester substrate used in the invention contains a base polyester layer and an ink-permeable upper polyester layer. This substrate is described more fully in U.S. application Ser. No. 09/472,487 of Laney et al. filed Dec. 27, 1999, entitled, "Permeable Surface Imaging Support", the disclosure of which is hereby incorporated by reference.

The substrate used in this invention may be made on readily available polyester film formation machines. The substrate is preferably prepared in one step with the ink-permeable upper polyester layer and the base polyester layer being coextruded, stretched, and integrally connected during formation. The one step formation process leads to low manufacturing cost. The substrate used in this invention has rapid absorption of ink, as well as high absorbent capacity, which allows rapid printing and a short dry time. A short dry time is advantageous, as the prints are less likely to smudge and have higher image quality as the inks do not coalesce prior to drying.

The substrate employed in this invention has the look and feel of paper, which is desirable to the consumer, has a desirable surface look without pearlescence, presents a smooth desirable image, is weather resistant and resistant to curling under differing humidity conditions, and has high resistance to tearing and deformation.

The base and upper polyester layers of the coextruded substrate have levels of voiding, thickness, and smoothness adjusted to provide optimum ink absorbency, stiffness, and gloss properties. The upper polyester layer contains voids to efficiently absorb the printed inks commonly applied to ink-jet imaging supports without the need of multiple processing steps and multiple coated layers.

The base polyester layer of the substrate provides stiffness to the substrate employed in the invention and provides physical integrity to the upper permeable layer. The thickness of the base polyester layer is chosen so that the total substrate thickness is 50 to 500 $\mu$m depending on the required stiffness of the film. However, the thickness of the upper polyester layer is adjusted to the total absorbent capacity of the ink recording element. A thickness of at least 28.0 $\mu$m is needed to achieve a total absorbency of 14 cc/$M^2$.

The ink-permeable upper polyester layer preferably contains voids that are interconnected or open-celled. This type of structure enhances ink absorption rate by enabling capillary action to occur.

As described above, the ink-permeable upper polyester layer has an absorbing rate resulting in a dry time of less than 10 seconds. Dry time may be measured by printing a color line on the side of the upper layer with an HP 722 inkjet printer using a standard HP dye-based ink cartridge (HP # C1823A) at a laydown of approximately 14 cc/$m^2$.

Dry time is measured by superposing a piece of bond paper on top of the printed line pattern immediately after printing and pressing the papers together with a roller press. If a particular printed line transfers to the surface of the bond paper, its transferred length L could be used for estimating the dry time $t_D$ using a known linear transport speed S for the printer based on the formula $$t_D = L/S$$

In a preferred embodiment, the ink absorbency rate results in a measured dry time of less than about one second.

The thickness of the upper polyester layer should be such as to enable at least 14.0 cc of ink to be absorbed per 1 $m^2$. The actual thickness can be determined by using the formula t=14.0/v where v is the void volume fraction defined as the ratio of voided thickness minus unvoided thickness to the voided thickness. The unvoided thickness is defined as the thickness that would be expected had no voiding occurred.

The polyester utilized in the upper layer, in general, should have a glass transition temperature between about 50° C. and 150° C., preferably between about 60–100° C., should be stretchable, and have an inherent viscosity of at least about 0.5, preferably about 0.6 to about 0.9 dl/g. Suitable polyesters include those produced from aromatic, aliphatic, or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques e.g., those described in U.S. Pat. Nos. 2,465,319 and 2,901,466, the disclosures of which are hereby incorporated by reference. Preferred continuous matrix polymers are those have repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510, the disclosures of which are hereby incorporated by reference.

The base polyester layer is usually substantially impermeable. In a preferred embodiment, the base polyester layer is poly(ethylene terephthalate) or copolymers thereof.

Voids in the ink-permeable upper polyester layer may be obtained by using microbeads during its fabrication. Such microbeads may be inorganic fillers or polymerizable organic materials. The particle size of the microbeads is preferably in the range of from about 0.1 to about 50 $\mu$m, more preferably from about 0.5 to about 5 $\mu$m, for best formation of an ink porous but smooth surface. The microbeads may be employed in an amount of 30–50% by volume in the feed stock for the ink-permeable upper polyester layer prior to extrusion and microvoiding. Typical inorganic materials for the microbeads include silica, alumina, calcium carbonate, and barium sulfate. Typical polymeric organic materials for the microbeads include polystyrenes, polyamides, fluoro polymers, poly(methyl methacrylate), poly(butyl acrylate), polycarbonates, or polyolefins.

In another preferred embodiment of the invention, the substrate has paper laminated to the other side of the base polyester layer which does not have thereon the image-receiving layer. In this embodiment, the base polyester layer of the substrate may be thin, as the paper would provide sufficient stiffiess.

In another embodiment of the invention, the substrate also contains a lower permeable layer adjacent to the base polyester layer on the opposite side from the ink-permeable upper polyester layer.

As noted above, the porous image-receiving layer used in the invention contains interconnecting voids. These voids provide a pathway for an ink to penetrate appreciably into the substrate, thus allowing the substrate to contribute to the dry time. A non-porous image-receiving layer or a porous image-receiving layer that contains closed cells will not allow the substrate to contribute to the dry time.

Interconnecting voids in an image-receiving layer may be obtained by a variety of methods. For example, the layer may contain particles dispersed in a polymeric binder. The particles may be organic such as poly(methyl methacrylate), polystyrene, poly(butyl acrylate), etc. or inorganic such as silica, alumina, zirconia, titania, calcium carbonate or barium sulfate. In a preferred embodiment of the invention, the particles have a particle size of from about 5 nm to about 15 $\mu$m.

The polymeric binder which may be used in the image-recording layer of the invention, can be, for example, a hydrophilic polymer such as poly(vinyl alcohol), polyvinyl acetate, polyvinyl pyrrolidone, gelatin, poly(2-ethyl-2-oxazoline), poly(2-methyl-2-oxazoline), poly( acrylamide), chitosan, poly(ethylene oxide), methyl cellulose, ethyl cellulose, hydroxyethyl cellulose, hydroxypropyl cellulose, etc. Other binders can also be used such as hydrophobic materials such as poly(styrene-co-butadiene), a polyurethane latex, a polyester latex, poly(n-butyl acrylate), poly (n-butyl methacrylate), poly(2-ethylhexyl acrylate), a copolymer of n-butylacrylate and ethylacrylate, a copolymer of vinylacetate and n-butylacrylate, etc.

In another preferred embodiment of the invention, the volume ratio of the particles to the polymeric binder is from about 1:1 to about 15:1.

Other additives may also be included in the image-receiving layer such as pH-modifiers like nitric acid, cross-linkers, rheology modifiers, surfactants, UV-absorbers, biocides, lubricants, dyes, dye-fixing agents or mordants, optical brighteners etc.

An image-receiving layer may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

After coating, the ink jet recording element may be subject to calendering or supercalendering to enhance surface smoothness.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Preparation of Ink-Permeable Polyester Substrate

A two-layered polyester substrate comprising an impermeable base polyester layer and an ink-permeable upper polyester layer is prepared in the following manner. The materials used in the preparation are: 1) a poly(ethylene terephthalate) (PET) resin (IV=0.70 dl/g ) for the base layer; 2) a compounded blend consisting of 32% by weight of an amorphous polyester resin, PETG 6763® resin (IV=0.73 dl/g) (Eastman Chemical Company) and 68% by weight barium sulfate particles approximately 1 um in size (Sachtleben Chemie) for the top layer.

The barium sulfate was compounded with the PETG 6763® resin through mixing in a counter-rotating twin screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approximately 500 $\mu$m. The cast sheet was first oriented in the machine direction by stretching at a ratio of 3.3 and a temperature of 110° C.

The oriented substrate was then stretched in the transverse direction in a tenter frame at a ratio of 3.3 and a temperature of 100° C. In this example, no heat setting treatment was applied. The final total film thickness was 100 $\mu$m with the permeable layer being 50 $\mu$m, and the layers within the substrate were fully integrated and strongly bonded. The stretching of the heterogeneous top layer created interconnected microvoids around the hard barium sulfate beads, thus rendering this layer opaque (white) and highly porous and permeable. The PET base layer, however, was impermeable and retained its natural clarity.

Porous Composition 1

Water: 66 parts

Aerosil Mox 80® silica (Degussa Corporation): 8 parts

Nalco 2329® colloidal silica (Nalco Chemical Co.): 18 parts

N-(2-aminoethyl)-3-aminopropylmethyldimethoxysilane (United Chemicals

Technologies, Inc.): 1 part

Styrene/butyl acrylate core shell latex: 6 parts

Kymene 557H ® wet strength resin (Hercules Inc.): 1 part

The Aerosil Mox 80® silica was added to a 40% solution of Nalco 2329® colloidal silica with stirring over a one hour time period. N-(2-aminoethyl)-3-aminopropylmethyldimethoxysilane was added to this mixture and the mixture was sonicated for 12 hours. The styrene/butyl acrylate core shell latex, and Kymene 557H® wet strength resin were added to the resulting solution and stirred for 30 minutes.

Porous Composition 2

Syloid 620® silica (Grace Davison): 6.5 parts

Gohsenol GH-23® poly(vinyl alcohol) (The Nippon Synthetic Chemical Industry

Co., Ltd.): 3.5 parts

Water: 90 parts

The Gohsenol GH-23® poly(vinyl alcohol) was added with stirring to water over a 20 minute time period. The mixture was then heated to 90° C. and stirred until a clear solution was obtained. This solution was cooled to room temperature and the Syloid 620® silica was added with stirring.

Porous Composition 3

GASIL HP39® silica gel (Crossfield Limited): 6.5 parts

Gohsenol GH-23® poly(vinyl alcohol): 3.5 parts

Water: 90 parts

Gobsenol GH-23® poly(vinyl alcohol) was slowly added with stirring to room temperature water over a 20 minute time period. The mixture was then heated to 90° C. and stirred until a clear solution was obtained. This solution was cooled to room temperature and the GASIL HP39® silica gel was added with stirring.

Non-Porous Composition C-1

Gohsenol GH-23® poly(vinyl alcohol): 10 parts

Water: 90 parts

Gohsenol GH-23® poly(vinyl alcohol) was slowly added with stirring to room temperature water over a 20 minute time period. The mixture was then heated to 90° C. and stirred until a clear solution was obtained.

Non-Porous Composition C-2

Photographic grade bone gelatin: 10 parts

Water: 90 parts

Photographic grade bone gelatin was slowly added to water. This mixture was allowed to sit at room temperature for 30 minutes. The mixture was then heated to 40° C. and stirred until a clear solution was obtained.

Element 1 of the Invention

The ink-permeable polyester substrate described above was coated at room temperature with Porous Composition 1 using a rod coater to give dry thickness of 4 μm. The coating was allowed to air dry for 12 hours before printing.

Element 2 of the Invention

This element was prepared the same as Element 1 except that it used Porous Composition 2.

Element 3 of the Invention

This element was prepared the same as Element 1 except that it used Porous Composition 3.

Control Element 1

This element was prepared the same as Element 1 except that it used Non-Porous Composition C-1.

Control Element 2

This element was prepared the same as Element 1 except that it used Non-Porous Composition C-2 and was coated at 40° C.

Control Element 3

This element was prepared the same as Element 1 except that it used Porous Composition 1 and Lumirror® void containing polyester film support, E-63S, 50 μm, (Toray Industries, Inc.) as disclosed in Examples 1, 2, 4 and 5 of U.S. Pat. No. 5,354,601.

Control Element 4

This element was prepared the same as Element 1 except that it used Non-Porous Composition 1 and Lumirror® void containing polyester film support, E-63S, 50 μm.

Control Element 5

This element was prepared the same as Element 1 except that it used Porous Composition 1 and Crisper® void containing polyester film support G2312, 100 μm, ( Toyobo Co., Ltd.) as disclosed in Example 5 of U.S. Pat. No. 5,354,601.

Control Element 6

This element was prepared the same as Element 1 except that it used Non-Porous Composition C-1 and Crisper® void containing polyester film support G2312, 100 μm.

Control Element 7

This element was tested using the Permeable Support of the Invention alone without any image-receiving composition.

Control Element 8

This element was tested using the Lumirror® void containing polyester film support, E-63S, 50 μm, alone without any image-receiving composition.

Control Element 9

This element was tested using the Crisper® void containing polyester film support G2312, 100 μm, alone without any image-receiving composition.

Printing

Images were printed using an Epson Stylus Color 900 printer for dye-based inks using Color Ink Cartridge T005 011 and Black Ink Cartridge T003 011. The images comprised a series of cyan, magenta, yellow, black, green, red and blue stripes, each stripe being in the form of a rectangle 1.1 cm in width and 18 cm in length.

Dry Time

Immediately after ejection from the printer, the printed image was set on a rubber mat (image side up) and a piece of bond paper was placed over the printed image. A steel cylinder (33 cm long, 5 cm in diameter and weighing 1747 g) was then rolled over the top of the bond paper, after which the bond paper was separated from the printed image. The samples were rated for dry time based on the length of dye transfer and the stripe densities on the bond paper. This is an estimate of the time needed for the printed image to dry. The dry time was rated as 1 when there was no transfer of the inks to the bond paper. The dry time was rated as 5 when there was full transfer of the color stripes to the bond paper and the density of the transferred stripes was high. Intermediate transfer lengths and densities were rated in-between 1 and 5. Only the cyan, magenta and yellow stripes were measured in the dry time evaluation.

Image Density

The cyan density of the cyan stripe on the printed image was measured using an X-Rite® Densitometer Model 820. Densities of 1.0 or greater and considered acceptable for most imaging applications. The following results were obtained:

TABLE

| Element | Coating | Support | Dry Time | Cyan Density |
|---|---|---|---|---|
| 1 | Porous Composition 1 | Permeable Substrate | 1 | 1.82 |
| 2 | Porous Composition 2 | Permeable Substrate | 1 | 1.10 |
| 3 | Porous Composition 3 | Permeable Substrate | 1 | 1.35 |
| Control 1 | Non-Porous Composition C-1 | Permeable Substrate | 3.5 | 2.99 |
| Control 2 | Non-Porous Composition C-2 | Permeable Substrate | 3.5 | 1.72 |
| Control 3 | Porous Composition 1 | Lumirror ® | 5 | 1.86 |
| Control 4 | Non-Porous Composition C-1 | Lumirror ® | 3 | 3.02 |
| Control 5 | Porous Composition 1 | Crisper ® | 5 | 1.88 |
| Control 6 | Non-Porous Composition C-1 | Crisper ® | 2.5 | 2.63 |
| Control 7 | None | Permeable Substrate | 1 | 0.68 |
| Control 8 | None | Lumirror ® | 5 | 0.29 |
| Control 9 | None | Crisper ® | 5 | 0.31 |

The above results show that receiving elements employed in the invention gave both good dry times and good printed densities, as compared to the control elements. While Control Elements 1–6 show that good printed densities can be obtained, they had poor dry time results. While Control 7 had a good dry times, it had a low printed density. Controls 8 and 9 had poor dry times and low printed densities.

This invention has been described with particular reference to preferred embodiments thereof but it will be understood that modifications can be made within the spirit and scope of the invention.

What is claimed is:

1. An ink jet recording element comprising an ink-permeable polyester substrate comprising a base polyester layer and an ink-permeable upper polyester layer, said upper polyester layer comprising a continuous polyester phase having an ink absorbency rate resulting in a dry time of less than about 10 seconds and a total absorbent capacity of at least about 14 cc/m$^2$, said substrate having thereon a porous image-receiving layer having interconnecting voids.

2. The recording element of claim 1 wherein said porous image receiving layer having interconnecting voids comprises particles dispersed in a polymeric binder.

3. The recording element of claim 2 wherein said particles are inorganic.

4. The recording element of claim 3 wherein said inorganic particles comprise silica, alumina, zirconia, titania, calcium carbonate or barium sulfate.

5. The recording element of claim 2 wherein said particles are organic.

6. The recording element of claim 2 wherein said polymeric binder comprises a hydrophilic binder.

7. The recording element of claim 6 wherein said hydrophilic binder comprises poly(vinyl alcohol), poly(vinyl acetate), poly(vinyl pyrrolidone), gelatin, poly(2-ethyl-2-oxazoline), poly(2-methyl-2-oxazoline), poly( acrylamide), chitosan, poly(ethylene oxide), methyl cellulose, ethyl cellulose, hydroxyethyl cellulose or hydroxypropyl cellulose.

8. The recording element of claim 2 wherein said polymeric binder comprises a hydrophobic binder.

9. The recording element of claim 8 wherein said hydrophobic binder comprises poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate or a copolymer of vinylacetate and n-butylacrylate.

10. The recording element of claim 2 wherein the volume ratio of said particles to said binder is from about 1:1 to about 15:1.

11. The recording element of claim 1 wherein said particles have a particle size of from about 5 nm to about 15 $\mu$m.

12. The recording element of claim 1 wherein said base polyester layer is substantially impermeable.

13. The recording element of claim 1 wherein said base polyester layer comprises a voiding agent to an extent less than about 25% by volume and is substantially impermeable.

14. The recording element of claim 1 wherein said base polyester layer comprise poly(ethylene terephthalate).

15. The recording element of claim 1 wherein said continuous polyester phase of said upper polyester layer comprises poly(ethylene terephthalate), poly(ethylene-1,4-cyclohexylenedimethylene terephthalate), or blends thereof.

16. The recording element of claim 1 wherein said ink-permeable upper polyester layer comprises a voiding agent present in an amount of from about 30% to about 50% by volume of said permeable layer.

17. The recording element of claim 16 wherein said ink-permeable upper polyester layer has interconnecting voids.

18. The recording element of claim 1 wherein said substrate further comprises a lower permeable layer adjacent to said base polyester layer on the opposite side from said ink-permeable upper polyester layer.

19. The recording element of claim 18 wherein said lower permeable layer has interconnecting voids.

20. The recording element of claim 1 wherein said substrate further comprises paper laminated to the side of said base polyester layer which does not have thereon said image-receiving layer.

* * * * *